United States Patent [19]

Okada

[11] 4,389,776

[45] Jun. 28, 1983

[54] REPLACEABLE BLADE TYPE KNIFE

[75] Inventor: Saburo Okada, Osaka, Japan

[73] Assignee: Okada Kogyo Kabushiki Kaisha, Osaka, Japan

[21] Appl. No.: 272,896

[22] Filed: Jun. 12, 1981

[30] Foreign Application Priority Data

Sep. 12, 1980 [JP] Japan ..... 55/130886[U]

[51] Int. Cl.[3] ..... B26B 1/08

[52] U.S. Cl. ..... 30/162; 30/320; 30/335; 30/339

[58] Field of Search ..... 30/162, 320, 335, 337, 30/339, 151

[56] References Cited

U.S. PATENT DOCUMENTS

| | | | |
|---|---|---|---|
| 4,063,356 | 12/1977 | Hepworth | 30/162 |
| 4,170,062 | 10/1979 | Machida | 30/162 |
| 4,200,977 | 5/1980 | Kageyama et al. | 30/162 |
| 4,292,738 | 10/1981 | Osada | 30/162 |
| 4,322,885 | 4/1982 | Osada | 30/162 |

*Primary Examiner*—James G. Smith
*Assistant Examiner*—Debra S. Meislin
*Attorney, Agent, or Firm*—Wenderoth, Lind & Ponack

[57] ABSTRACT

A replaceable blade type knife in which the blade is replaced at an intermediate point between opposite longitudinal ends of the case body so as to improve the operational efficiency and safety of the knife. The knife includes a restrictive arrangement for enabling dismounting of the sliding member from the guide grooves of the case body at a specific position within the guide stroke of the sliding member other than at the opposite ends of the guide stroke and for unreleasably restricting the sliding member in the guide grooves of the case body at positions other than the specific position so as to allow the sliding member to slide in the guide grooves of the case body, and thus, the knife has been made compact in size so as to be suitable for portable use, with a wide range of application to office works, handicraft, etc.

4 Claims, 19 Drawing Figures

REPLACEABLE BLADE TYPE KNIFE

The present invention generally relates to a knife and more particularly, to a knife having a replaceable blade.

Generally, in conventional replaceable blade type knives, it has been so arranged that a blade is replaced outside the lengthwise ends of a case body of the knife and thus, the profile or external configuration of the knife has been inevitably complicated. Therefore, the knife of such a known arrangement has not been suited for portable use and has offered various problems in operational safety and efficiency.

Accordingly, an essential object of the present invention is to provide an improved replaceable blade type knife in which a blade is replaced at an intermediate point between the two lengthwise ends of a case body so as to improve the operational efficiency and safety.

Another important object of the present invention is to provide an improved replaceable blade type knife as described above which is simple in structure, highly reliable in actual use and suitable for mass production at low cost.

In accomplishing these and other objects according to one preferred embodiment of the present invention, there is provided an improved replaceable blade type knife which comprises restrictive means for enabling dismounting of a sliding member from guide grooves of a case body at a specific position within a guide stroke of the sliding member other than the opposite ends of the guide stroke and for unreleasably restricting the sliding member in the guide grooves of the case body at positions other than the specific portion so as to allow the sliding member to slide in the guide grooves of the case body, the restrictive means comprising recess portions formed on the case body and boss portions so formed on the sliding member as to be fitted into the recess portions when dismounting of the sliding member. In accordance with the present invention, the blade releasably coupled to the sliding member is replaced at an intermediate position between both lengthwise ends of the case body, so that the knife may be compact in size so as to be suitable for portable use and has a wide range of application to office works, handicraft, etc.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout the views of the accompanying drawings.

DETAILED DESCRIPTION OF THE INVENTION

Figure 1A:
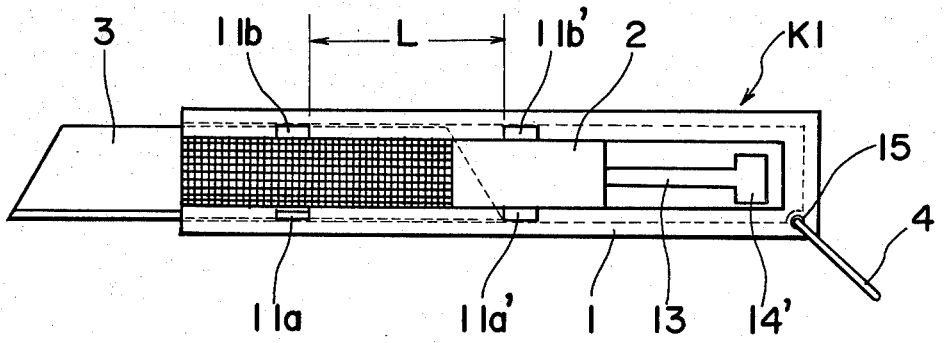
FIG. 1(*a*) is a front elevational view of a replaceable blade type knife according to one preferred embodiment of the present invention, showing a sliding member disposed at a first position with respect to a case body, FIG. 1(*b*) is a bottom plan view of the knife of FIG. 1(*a*), FIG. 1(*c*) is a rear elevational view of the knife of FIG. 1(*a*), FIG. 1(*d*) is a left side elevational view of the knife of FIG. 1(*a*), FIG. 2(*a*) is an exploded view of the knife of FIG. 1(*a*), showing the sliding member disposed at a second position with respect to the case body, FIG. 2(*b*) is an enlarged perspective view of the sliding member of FIG. 2(*a*), FIG. 3(*a*) is a side elevational view of the sliding member of FIG. 2(*a*), FIG. 3(*b*) is a rear elevational view of the sliding member of FIG. 3(*a*)
Figure 1B:
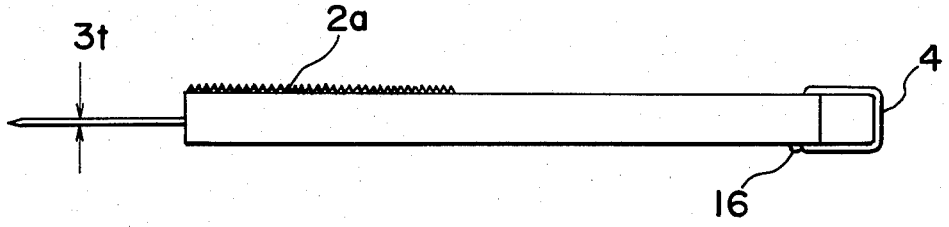
Figure 1C:
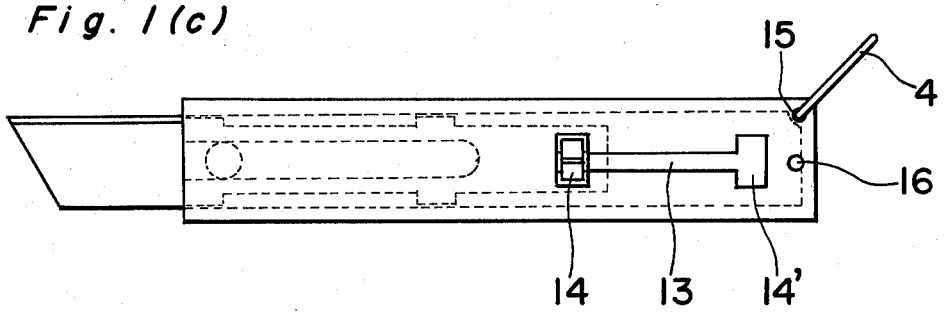
Figure 1D:
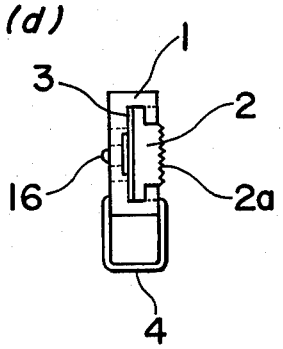

Referring now to the drawings, there is shown in FIGS. 1(*a*) to 7(*c*), a replaceable blade type knife K1 according to one preferred embodiment of the present invention which generally includes an elongated case body 1 having a generally C-shaped cross section, an elongated sliding member 2 slidably accommodated in said case body 1, an elongated replaceable blade 3 having a cutting edge 3*b* along one longitudinal side thereof and a clip 4 pivotally connected at one longitudinal rear corner of the case body 1 for securely locking the sliding member 2 in the case body 1 when not in use.

Figure 2A:
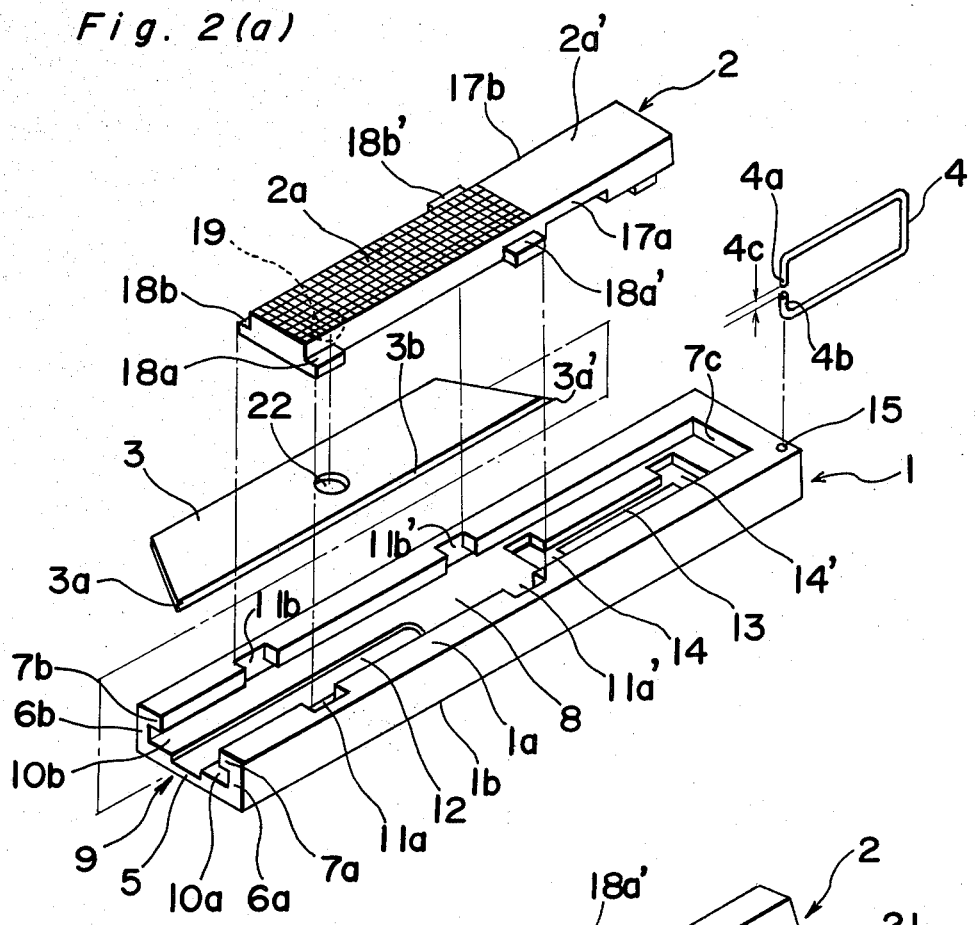
Figure 2B:
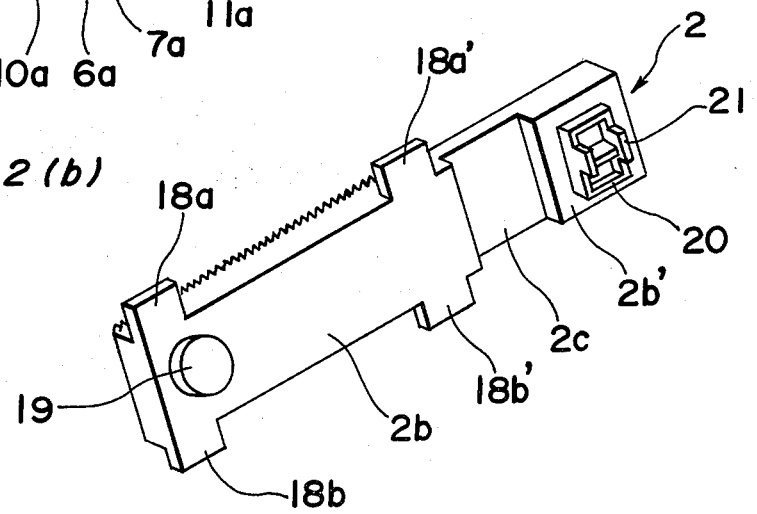
Figure 3A:
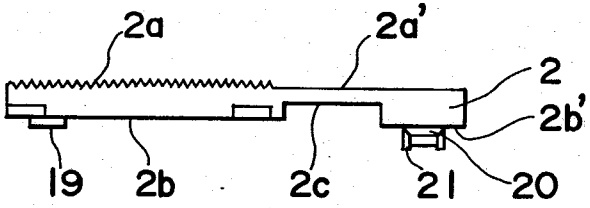
Figure 3B:
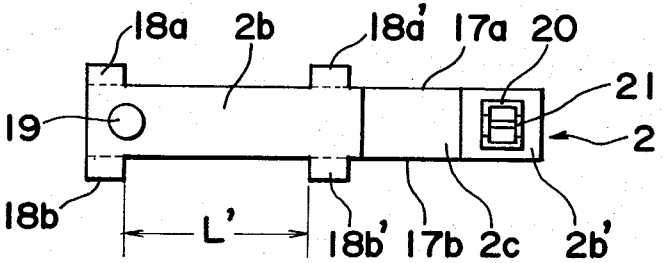

Referring to FIGS. 2(*a*) and 4, the elongated case body 1 comprises a longitudinal base portion 5 having a guideway 8 on one face thereof for sliding thereon the blade 3 and the sliding member 2, peripheral walls 6*a*, 6*b* and 6*c* projecting outwards from the base portion 5 at opposed longitudinal sides thereof and at a longitudinal rear end thereof, respectively, in a direction at right angles thereto, and lip portions 7*a*, 7*b* and 7*c* protruding inwards from the peripheral walls 6*a*, 6*b* and 6*c*, respectively, in parallel with the guideway 8, and an opening 9 formed at a longitudinal forward end of the case body 1 for selective projection and retraction of the blade 3 therethrough, whereby the opposed longitudinal lip portions 7*a* and 7*b*, the opposed longitudinal peripheral walls 6*a* and 6*b*, and the base portion 5 form the C-shaped cross section of the case body 1.

One face of the lip portions 7*a*, 7*b*, and 7*c*, opposite to the guideway 8 and the other face of the base portion 5, opposite to the guideway 8 will be referred to as a top face 1*a* and a bottom face 1*b* of the case body 1, respectively, hereinbelow.

As shown in FIG. 2(*a*), the lip portion 7*a* and the peripheral wall 6*a*, and the lip portion 7*b* and the peripheral wall 6*b* form, with the guideway 8, opposed dovetail grooves or guide grooves 10*a* and 10*b*, respectively, longitudinally extending along inner side edges of opposed longitudinal peripheral walls 6*a* and 6*b*, respectively.

The opposed longitudinal lip portion 7*a* and 7*b* are provided with rectangular recess portions 11*a* and 11*b*, respectively, formed at respective forward positions thereof and rectangular recess portions 11*a'* and 11*b'* respectively, formed approximately at respective longitudinal middle positions thereof so that recess portions 11*a* and 11*a'* confront recess portions 11*b* and 11*b'*, respectively. Since the recess portions 11*a*, 11*a'*, 11*b* and 11*b'* are the same size, the recess portions 11*a* and 11*b* are spaced by a predetermined distance L from recess portions 11*a'* and 11*b'*, respectively.

The base portion 5 is provided with a longitudinal groove 12 which opens into guideway 8 and is formed at one longitudinal forward portion and at the central position in a widthwise direction of said guideway 8, a longitudinal guide slot 13 which is communicated with the bottom face 1*b* of the case body 1 and formed at one longitudinal rear portion and at the central position in a widthwise direction of said guideway 8, rectangular openings 14 and 14' which are communicated with the bottom face 1*b* of the case body 1 and formed at longitudinal forward and rear ends of the guide slot 13, respectively, said openings 14 and 14' being the same size.

The case body 1 further includes a through-hole 15 formed at one longitudinal rear corner of the top face 1*a* thereof and a hemispherical projection 16 formed at one longitudinal rear position and at the central portion in the widthwise direction of the bottom face 1*b* thereof, as shown in FIGS. 1(*c*), 1(*d*) and 2(*a*).

As shown in FIGS. 2(*a*), 2(*b*), 3(*a*) and 3(*b*), the elongated sliding member 2 comprises one longitudinal face facing the guideway 8 of the case body 1, (hereinbelow referred to as a bottom face), the other longitudinal face opposite to the bottom face, (hereinbelow referred to as a top face), one longitudinal side 17*a* and the other longitudinal side 17*b* opposite to the longitudinal side 17*a*.

Opposite longitudinal sides 17*a* and 17*b* of the sliding member 2 are so formed as to slidably contact, respectively, opposed longitudinal inner sides of the lip portions 7*a* and 7*a'* of the case body 1 and are provided with rectangular plate-like boss portions 18*a* and 18*b*, respectively, formed at respective forward ends of said longitudinal sides 17*a* and 17*b* and rectangular plate-like boss portions 18*a'* and 18*b'*, respectively, formed approximately at respective longitudinal middle positions of said longitudinal sides 17*a* and 17*b* so that boss portions 18*a* and 18*a'* are opposite boss portions 18*b* and 18*b'*, respectively. Boss portions 18*a* and 18*b* are, respectively, spaced, by a predetermined distance L', from boss portions 18*a'* and 18*b'* so that boss portions 18*a*, 18*a'*, 18*b* and 18*b'* may be, respectively, slidably fitted into recess portions 11*a*, 11*a'*, 11*b* and 11*b'* of the case body 1 with said boss portions 18*a*, 18*a'*, 18*b* and 18*b'* being slightly smaller than recess portions 11*a*, 11*a'*, 11*b* and 11*b'* of the case body 1.

The top face of the sliding member 2 comprises a bearing face 2*a* having many indentations to be engaged by a finger of an operator at a longitudinal forward portion thereof so as to avoid any possible slip of the operator's finger relative to the sliding member 2, and a longitudinal rear portion 2*a'*.

The bottom face of the sliding member 2 comprises a longitudinal forward portion 2*b* in contact with the blade 3, a longitudinal intermediate recess portion 2*c* and a longitudinal rear portion 2*b'*. The longitudinal forward portion 2*b* of the bottom face of the sliding member 2 is formed with, at a longitudinal forward portion and at the central position in a widthwise direction of said sliding member 2, a cylindrical boss 19. The longitudinal rear portion 2*b'* of the bottom face of the sliding member 2 is formed with, at the longitudinal central portion and at the central position in a widthwise direction of said sliding member 2, a rectangular protruding portion 20 and a projecting portion 21 formed on the protruding portion 20.

The projecting portion 21 has a shape of an I-beam when viewed in a direction at right angles to the bottom face of the sliding member 2 and is smaller in size than the protruding portion 20.

Figure 4:
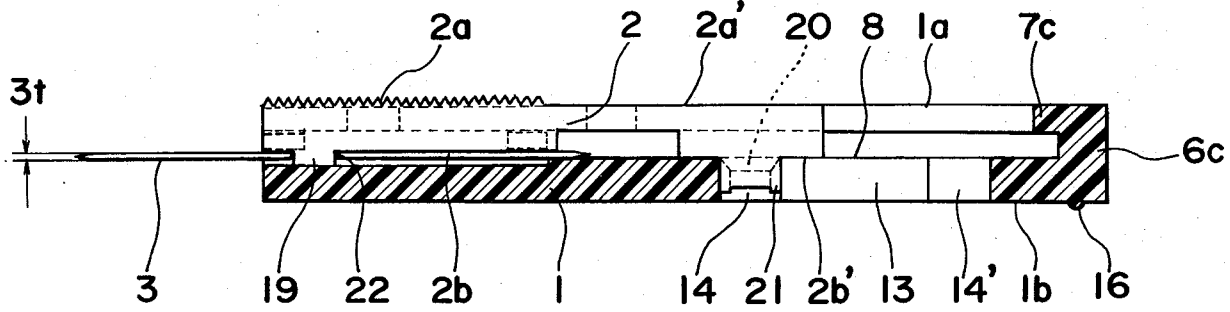
FIG. 4 is a cross-sectional view of the knife of FIG. 1(*b*), showing on an enlarged scale, the sliding member disposed at the first position with respect to the case body.
Figure 5:
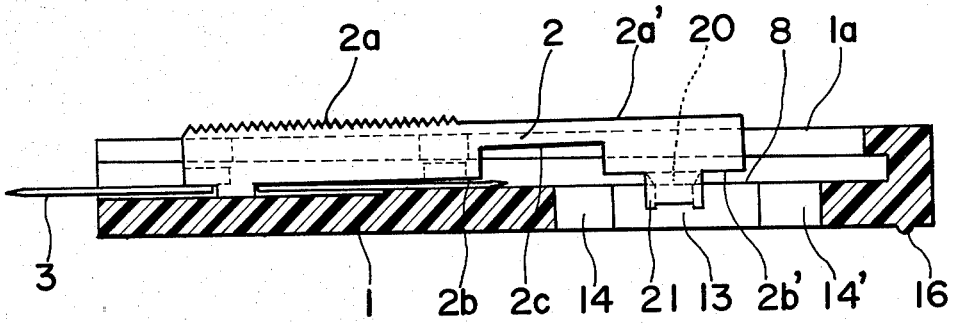
FIG. 5 is a view similar to FIG. 4, showing, on an enlarged scale, the sliding member 2 disposed at the second position with respect to the case body, FIG. 6(*a*) is a view similar to FIG. 4, showing, on an enlarged scale, the sliding member disposed at a third position with respect to the case body, FIG. 6(*b*) is a rear elevational view of the knife of FIG. 6(*a*), FIG. 7(*a*) is a fragmentary cross-sectional view similar to FIG. 5, specifically showing, on an enlarged scale, the sliding member disposed at one position between the first and third positions, FIG. 7(*b*) is a view similar to FIG. 7(*a*), specifically showing the sliding member disposed at the third position with respect to the case body, FIG. 7(*c*) is a view similar to FIG. 7(*b*), specifically showing the sliding member disposed at the third position with respect to the case body with a clip securely locking the sliding member in the case body.
Figure 6A:
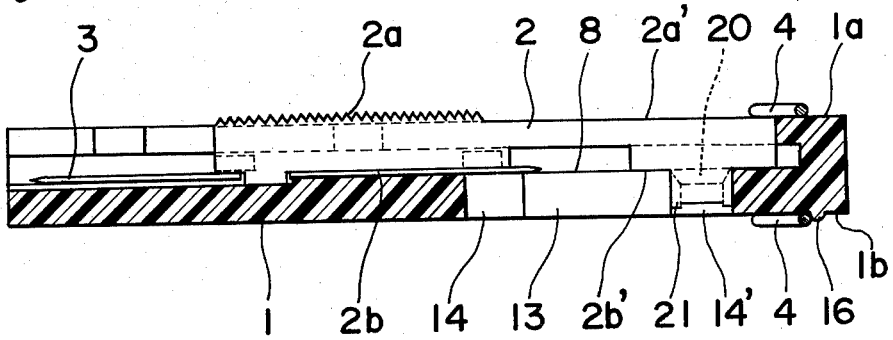
Figure 6B:
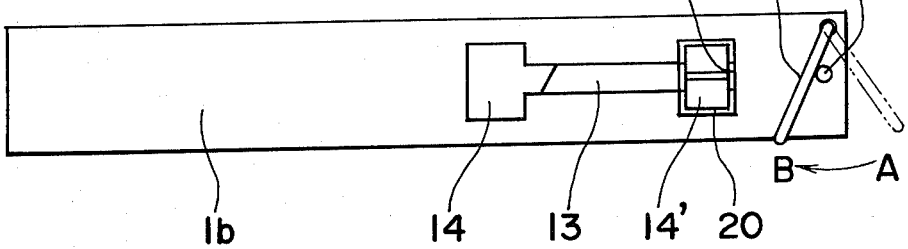

Furthermore, the longitudinal rear portion 2*b'* of the bottom face of the sliding member 2 is so formed as to project by a thickness 3*t* of the blade 3 (FIG. 1(*b*)) from the longitudinal forward portion 2*b* in a direction opposite to the top face of the sliding member 2 so that the top face of the sliding member 2 may be horizontal with respect to the guideway 8 of the case body 1 when the protruding portion 20 of the sliding member 2 is fitted into either the longitudinal forward or rear opening 14 or 14' of the case body 1, as shown in FIGS. 4 and 6(*a*) which illustrate the longitudinal rear portion 2*b'* of the bottom face of the sliding member 2 in contact with the guideway 8 of the case body 1.

As shown in FIG. 2(*a*), the elongated blade 3 has a shape of a symmetric trapezoid and is made of stainless steel.

The blade 3 is provided with a hole 22 formed at the longitudinal central portion and at the central position in a widthwise direction of said blade 3 and with edges 3*a* and 3*a'* formed at longitudinal forward and rear ends of the cutting edge 3*b*, respectively.

As shown also in FIG. 2(*a*), the clip 4 is made of a piece of wire and is bent in a rectangular shape with one lateral side having a slight clearance 4*c* between the two wire ends 4*a* and 4*b*. Both ends 4*a* and 4*b* of the clip 4 are fitted into the through-hole 15 of the case body 1 from the top face 1*a* and the bottom face 1*b* thereof, respectively by forcibly extending the clearance 4*c*.

Since the clip 4 is not required to be removed from the case body 1 during the actual use of the knife K1, the case body 1 provided with the clip 4 will be described hereinbelow.

Furthermore, the case body 1 and the sliding member 2 are manufactured by the utilization of any known plastic molding technique, for example, either an extrusion molding method or an injection molding method.

As shown in FIGS. 2(*a*) and 5, the knife K1 of the present invention can be assembled by initially inserting, in a direction parallel to the plane of the slideway 8 of the case body 1, the blade 3 into the opening 9 formed at the longitudinal forward end of the case body 1, fitting, in a direction at right angles to the plane of the slideway 8, boss portion 18*a*, 18*a'*, 18*b* and 18*b'* of the sliding member 2 into recess portions 11*a*, 11*a'*, 11*b* and 11*b'* of the case body 1, respectively, by disposing the sliding member 2 at one longitudinal intermediate position with respect to the case body 1 (hereinbelow, referred to as a second position) and longitudinally sliding the blade 3 on the guideway 8 until the boss 19 of the sliding member 2 engages in the hole 22 of the blade 3. When the boss 19 is fitted into the hole 22, the sliding member 2 is releasably coupled to the blade 3, the boss 19 of the sliding member 2 engages in the groove 12 of the case body 1, the projecting portion 21 of the sliding member 2 is slidably fitted into the guide slot 13 of the case body 1, and opposed longitudinal guide grooves 10*a* and 10*b* receives therein boss portions 18*a* and 18*a*', and boss portions 18*b* and 18*b*', respectively and the blade 3, as shown in FIGS. 2(*a*) and 5.

When the bearing face 2*a* of the sliding member 2 is depressed by the operator's finger, the sliding member 2 and the blade 3 releasably coupled thereto are slidably guided in one unit on the guideway 8 of the case body 1 in a longitudinal direction within a predetermined guide stroke of the sliding member 2 which is equal to a stroke of the projecting portion 21 thereof in the guide slot 13 of the case body 1 while boss portions 18*a* and 18*a*', and boss portions 18*b* and 18*b*' of the sliding member 2 are, respectively, held in opposed longitudinal guide grooves 10*a* and 10*b* of the case body 1, whereby the longitudinal forward edge 3*a* of the blade 3 is selectively projected from and retracted into only the opening 9 of the case body 1 in a longitudinal direction with the projecting portion 21 of the sliding member 2 being concealed within the case body 1 at all times.

When the knife K1 of the present invention is in use and not in use, the sliding member 2 is disposed, respectively, at the most forward and rearward positions in a longitudinal direction with respect to the case body 1, as shown in FIGS. 1(*a*) to 1(*d*) and 4 (hereinbelow, referred to as a first position), and FIGS. 6(*a*) and 6(*b*) (hereinbelow, referred to as a third position), respectively, so that the blade 3 releasably coupled to the sliding member 2 is projected farthest out from and retracted farthest into the opening 9 of the case body 1 in a longitudinal direction, respectively and the protruding portion 20 of the sliding member 2 is, respectively, fitted into the openings 14 and 14' formed at the longitudinal forward and rear ends of the guide slot 13 of the case body 1, and thus, the sliding member 2 is positioned further into the case body 1 with the longitudinal rear portion 2*a*' of the top face of the sliding member 2 being flush with the top face 1*a* of the case body 1, as shown in FIGS. 4 and 6(*a*), respectively. Thus, the sliding member 2 and the blade 3 are releasably locked in the case body 1 until an external release force for disengaging the protruding portion 20 from either one of the openings 14 and 14' of the case body 1 is applied to the sliding member 2 by the operator's finger. As shown in FIG. 6(*a*), when the sliding member 2 is disposed at the third position with respect to the case body 1, the blade 3 is concealed within the case body 1 for safety.

Figure 7A:
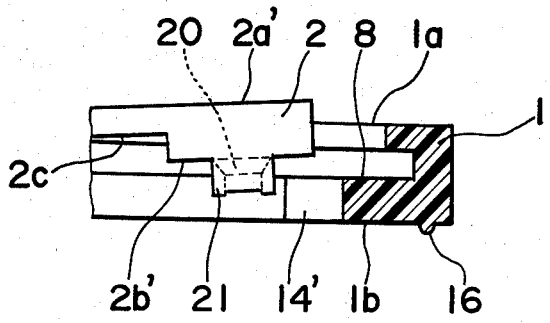
Figure 7B:
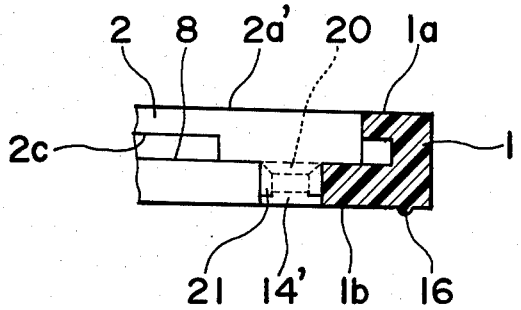
Figure 7C:
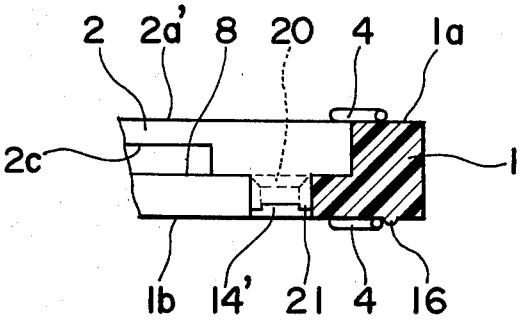

On the other hand, when the sliding member 2 is disposed between the first position and the third position with respect to the case body 1, the protruding portion 20 formed at the longitudinal rear portion of the sliding member 2 is not fitted into either one of the longitudinal forward and rear openings 14 and 14' of the case body 1 while the boss portions 18*a* and 18*a*', and the boss portions 18*b* and 18*b*', formed at the forward portion of the sliding member 2, is held in the guide grooves 10*a* and 10*b* of the case body 1, respectively and thus, the longitudinal rear portion 2*a*' of the top face of the sliding member 2 is elastically raised a slight distance from the top face 1*a* of the case body 1 slantways, as shown in FIG. 7(*a*).

As described earlier, when the protruding portion 20 of the sliding member 2 is fitted into the longitudinal rear opening 14' of the case body 1, the blade 3 is releasably locked in the case body 1 and the longitudinal rear portion 2*a*' of the top face of the sliding member 2 is flush with the top face 1*a* of the case body 1, as shown in FIG. 7(*b*).

As shown in FIGS. 6(*a*) and 6(*b*), when the clip 4 is pivoted in the through-hole 15 of the case body 1 beyond the hemispherical projection 16 from a position A shown in imaginary lines to a position B shown in solid line when the protruding portion 20 of the sliding member 2 has been fitted into the longitudinal rear opening 14' of the case body 1, the clip 4 embraces the top face 1*a* and the bottom face 1*b* of the case body 1 and thus, the longitudinal rear portion 2*a*' of the top face of the sliding member 2, flush with the top face 1*a* of the case body 1, is embraced by the clip 4, so that the protruding portion 20 of the sliding member 2 is prevented from being disengaged from the longitudinal rear opening 14' of the case body 1, whereby the sliding member 2 and the blade 3 releasably coupled thereto are securely locked in the case body 1 (FIG. 7(*c*)) until an external release force for disengaging the clip 4 from the projection 16 of the case body 1 is applied to the clip 4.

The knife K1 of the present invention can be disassembled as follows. The bearing face 2*a* of the sliding member 2 is depressed by the operator's finger so as to longitudinally slide the sliding member 2 and the blade 3 releasably coupled thereto in the case body 1 so that the sliding member 2 is disposed at the second position with respect to the case body 1, whereby the boss portions 18*a*, 18*a*', 18*b* and 18*b*' of the sliding member 2 become fitted in the recess portions 11*a*, 11*a*', 11*b* and 11*b*' of the case body 1, respectively. Then the sliding member 2 is disengaged, in a direction at right angles to the plane of the guideway 8 of the case body 1, from the case body 1 and, at the same time, the boss 19 of the sliding member 2 is disengaged, in a direction at right angles to the plane of the guideway 8, from the hole 22 of the blade 3, whereby the sliding member 2 is disengaged from the blade 3. Then, the blade 3 loosely held in opposed longitudinal guide grooves 10*a* and 10*b* of the case body 1 is disengaged, in a direction parallel to the plane of the guideway 8, from the case body 1.

Furthermore, since the blade 3 has the shape of a symmetrical trapezoid and is formed with the hole 22 at the longitudinal central portion and at the central position in a widthwise direction of said blade 3, both the longitudinal forward and rear edges 3*a* and 3*a*' of the cutting edge 3*b* are interchangeable when either one of edges 3*a* and 3*a*' becomes blunt and the cutting edge 3*b* is reversible with respect to the opposed longitudinal guide grooves 10*a* and 10*b* of the case body 1, for both right-handed and left-handed uses.

Figure 8:
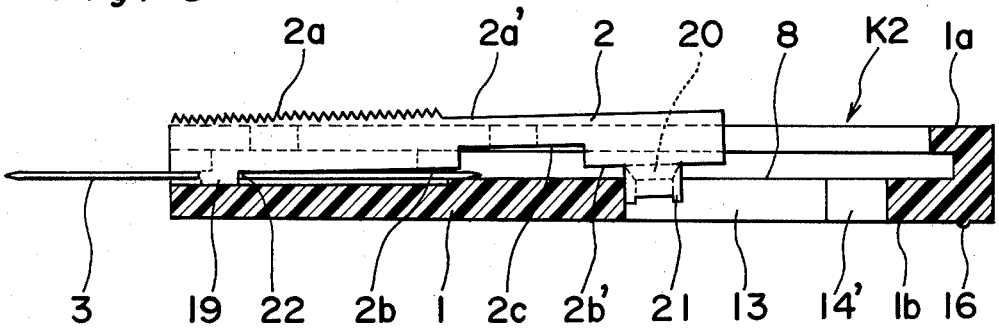
FIG. 8 is a view similar to FIG. 4, showing a modification thereof.

Referring further to FIG. 8, there is shown a modification of the replaceable blade type knife K1 of FIG. 1. In the modified replaceable blade type knife K2 in FIG. 8, the opening 14 of the rectangular openings 14 and 14' described as formed at the forward and rear ends of the guide slot 13 is omitted, and thus, said guide slot 13 is provided with only one opening 14'.

In the above modification, the sliding member 2 and the blade 3 are locked to a certain extent in the case body 1 when the knife K2 is not in use, and while the knife K2 is in use, they are not locked in the case body 1 but are held in the case body 1 due to friction between the protruding portion 20 of the sliding member 2 and the guideway 8 of the case body 1 since the longitudinal rear portion 2a' of the top face of the sliding member 2 is elastically raised from the top face 1a of the case body 1 slantways.

Since the remainder of the construction and effects of the modified knife K2 of FIG. 8 are similar to those in the knife K1 of FIG. 1(*a*), a detailed description thereof is omitted here for brevity, with like parts being designated by like reference numerals.

Figure 9A:
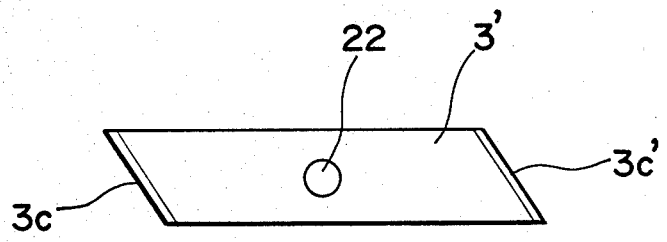
FIGS. 9(*a*), 9(*b*) and 9(*c*) are front elevational views showing modifications of the refillable blade of FIG. 2(*a*).
Figure 9B:
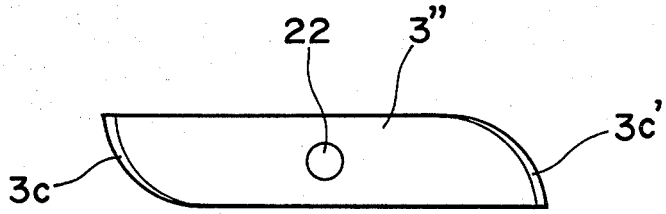
Figure 9C:
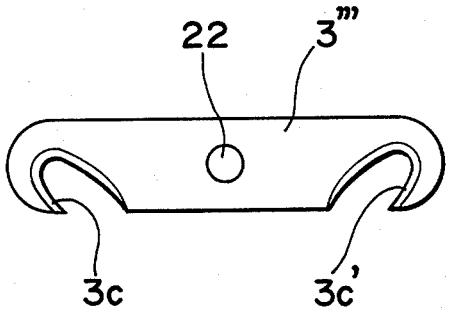

Referring to FIGS. 9(*a*), 9(*b*) and 9(*c*), there are shown modifications of the replaceable blade 3 of FIG. 2(*a*).

In the modified blade 3' in FIG. 9(*a*), cutting edges 3c and 3c' are provided at longitudinal forward and rear ends of the blade 3', respectively and are formed in parallel with each other and slantways with respect to a longitudinal side of the blade 3'.

In the modified blade 3'' in FIG. 9(*b*), cutting edges 3c and 3c' are provided at longitudinal forward and rear ends of the blade 3'', respectively and are formed into an arcuate shape so as to be symmetrical with respect to the hole 22.

In the modified blade 3'' in FIG. 9(*c*), cutting edges 3c and 3c' which are symmetrical with respect to the hole 22 are provided adjacent to longitudinal forward and rear ends of the blade 3''', respectively so as to be formed into arcuate recesses open to one longitudinal side of the blade 3''', so that the blade 3''' is suitable for cutting string, thread, etc.

In accordance with the present invention, the blade is arranged to be replaced at an intermediate position between longitudinal opposite ends of the case body by disposing the sliding member at one intermediate position (the second position) between the most forward position (the first position) and the most rearward position (the third position) in a longitudinal direction with respect to the case body and therefore, the knife is not only simplified with respect to the structure thereof, but highly reliable in actual use and suitable for mass production at low cost, whereby the operational safety and efficiency thereof has been improved remarkably.

Furthermore, when the knife of the present invention is in use and not in use, the sliding member is, respectively, disposed at the most forward position (the first position) and the most rearward position (the third position) in a longitudinal direction with respect to the case body, so that the blade releasably coupled to the sliding member is, respectively, projected farthest from and retracted farthest into the opening formed at the longitudinal forward end of the case body in a longitudinal direction with the blade being concealed within the case body for safety in the latter case.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as included therein.

What is claimed is:

1. A replaceable blade type knife which comprises:

a tubular case body having guide grooves formed along longitudinal side edges thereof, said guide grooves being formed with an opening at a longitudinal forward end of said body;

a blade having a cutting edge along one longitudinal side thereof, said blade being axially, slidably fitted into said guide grooves of said case body so as to be selectively projected from and retracted into said opening of said case body in a longitudinal direction;

a sliding member provided with a bearing surface to be depressed by a finger of an operator, and slidably fitted into said guide grooves of said case body, said blade being interposed between said case body and said sliding member so that said sliding member is guided together with said blade in one unit in said guide grooves of said case body within a predetermined guide stroke;

restrictive means for enabling dismounting of said sliding member from said guide grooves of said case body at a specific position within said guide stroke of said sliding member between the opposite ends of said guide stroke and for unreleasably holding said lifting member in said guide grooves of said case body at positions other than said specific position so as to allow said sliding member to slide in said guide grooves of said case body, said restrictive means comprising recess portions formed in said case body and boss portions so formed on said sliding member as to be fitted into said recess portions when dismounting said sliding member; and coupling means for releasably coupling said sliding member to said blade so that said sliding member and said blade are slidably guided in one unit in said guide grooves of said case body, whereby a longitudinal forward edge of said blade is selectively and slidably projected from and retracted into said open end of said case body in a longitudinal direction, with said sliding member being arranged to be dismounted from said blade at least at said specific position.

2. A replaceable blade type knife as claimed in claim 1, further comprising:

limiting means for limiting said guide stroke of said sliding member, which comprises a projecting portion formed on said sliding member and a guide slot formed in said case body for receiving said projecting portion so as to limit said guide stroke of said sliding member.

3. A replaceable blade type knife as claimed in claim 2, further comprising:

safety lock means for locking said sliding member in said case body, which comprises openings formed at longitudinal forward and rear ends of said guide slot of said case body, a protruding portion so formed on said sliding member as to be fitted into said openings formed at said forward and rear ends when said sliding member reaches said longitudinal forward and rear ends of said guide slot, respectively, and a clip pivotally connected to a hole formed in said case body for securely locking said sliding member at said rear end of said guide slot of said case body when said clip is pivoted about said hole of said case body beyond a projection on said case body so that said clip embraces said case body so as to prevent said protruding portion from being withdrawn from said rear opening of said case body when said protruding portion of said sliding member has been fitted into said rear opening of said case body, said projection being arranged to prevent said clip from being disengaged therefrom unless an external force for disengaging said clip from said projection is applied to said clip, said sliding member being locked in said case body when said protruding portion of said sliding member is fitted into either one of said forward and rear openings of said case body.

4. A replaceable blade type knife as claimed in claim 2, further comprising:

safety lock means for locking said sliding member in said case body, which comprises an opening formed at a longitudinal rear end of said guide slot of said case body, a protruding portion is formed on said sliding member as to be fitted into said opening formed at said rear end when said sliding member reaches said longitudinal rear end of said guide slot and a clip pivotally connected to a hole formed in said case body for securely locking said sliding member at said rear end of said guide slot of said case body when said clip is pivoted about said hole of said case body beyond a projection on said case body so that said clip embraces said case body so as to prevent said protruding portion from being withdrawn from said rear opening of said case body when said protruding portion of said sliding member has been fitted into said rear opening of said case body, said projection being arranged to prevent said clip from being disengaged therefrom unless an external force for disengaging said clip from said projection is applied to said clip, said sliding member being locked in said case body when said protruding portion of said sliding member is fitted into said rear opening of said case body.

* * * * *

UNITED STATES PATENT AND TRADEMARK OFFICE

CERTIFICATE OF CORRECTION

PATENT NO. : 4,389,776

DATED : June 28, 1983

INVENTOR(S) : Saburo Okada

It is certified that error appears in the above—identified patent and that said Letters Patent is hereby corrected as shown below:

On the title page add:

--[30] FOREIGN APPLICATION PRIORITY DATA

| | | |
|---|---|---|
| 9/12/80 | Japan | 130886/1980 |
| 5/21/81 | Japan | 74092/1981--. |

Signed and Sealed this

*Eighteenth* Day of *October 1983*

[SEAL]

*Attest:*

GERALD J. MOSSINGHOFF

*Attesting Officer*

*Commissioner of Patents and Trademarks*